United States Patent [19]

Roden

[11] 4,007,957

[45] Feb. 15, 1977

[54] HOOK ASSEMBLY

[76] Inventor: Mack L. Roden, 5210 N. Villa Ave., Clovis, Calif. 93612

[22] Filed: July 21, 1975

[21] Appl. No.: 597,945

[52] U.S. Cl. ..... 294/82 R; 24/232 R

[51] Int. Cl.[2] ..... B66C 1/36

[58] Field of Search ..... 294/82 R, 78 R, 83 R; 24/241 R, 241 P, 241 PP, 241 PL, 241 TC, 241 SL, 230.5 SA, 232, 238, 242, 231, 230.5 AC; 59/93, 95

[56] References Cited

UNITED STATES PATENTS

| | | | |
|---|---|---|---|
| 349,170 | 9/1886 | Morrow | 24/232 |
| 1,956,786 | 5/1934 | Bemis | 294/82 R |
| 2,928,692 | 3/1960 | Gowan | 294/82 R |
| 3,001,634 | 9/1961 | Bauder | 294/82 R |
| 3,741,606 | 6/1973 | Crook, Jr. | 294/82 R |
| 3,785,015 | 1/1974 | Dorton | 294/82 R |

*Primary Examiner*—James B. Marbert
*Attorney, Agent, or Firm*—Huebner & Worrel

[57] ABSTRACT

A hook assembly having a hook with a shank portion and being return bent to form an extremity defining a throat for the hook with the shank portion, a body, a shaft mounting the shank portion of the hook on the body for pivotal movement, a pair of substantially parallel projections mounted on the body bounding the shank portion to guide pivotal movement of the shank portion, and a flange borne by one of the projections extending into juxtaposition to the extremity of the hook to seal the throat when the hook is in a predetermined pivotal position.

3 Claims, 5 Drawing Figures

HOOK ASSEMBLY

BACKGROUND OF THE INVENTION

1. Field of the Invention:

The present invention relates to a hook assembly and more particularly to such a hook assembly which is characterized by a dependability of performance and safety of operation not heretofore achieved in prior art hook assemblies and which incorporates components which cooperate during operation to preclude jamming even under extreme load while insuring that a load supported thereon cannot inadvertently be discharged.

2. Description of the Prior Art:

The prior art, such as represented by the devices disclosed by the Morrow U.S. Pat. No. 349,170; the Larson U.S. Pat. No. 1,045,568; the Powers U.S. Pat. No. 1,144,430; and the Smith U.S. Pat. No. 3,126,604, has been directed to the development of a hook assembly which prevents the inadvertent discharge of a work load from the hook during use. Such hook assemblies are employed in a variety of environments such as in logging, the loading and unloading of vehicles, and in virtually every area of application where a heavy work load must be moved by other than purely manual labor. Prior art devices have suffered from several common deficiencies. For example, many such devices are not satisfactory in use in that the safety structures are easily broken or are inconvenient to operate under work conditions. Another difficulty residing in such prior art attempts has been the susceptibility of the devices to becoming jammed particularly where extreme loads and stresses placed on the devices during use result in some deformation of the interconnected components so as to impede or prevent cooperative movement.

Therefore, it has long been known that it would be desirable to have a hook assembly which is easily operated under work conditions and which operates dependably to prevent the inadvertent discharge of work loads therefrom and further which incorporates component parts which cooperate to preclude jamming even where some deformation of the components results from the exigencies of use.

SUMMARY OF THE INVENTION

It is therefore an object of the present invention to provide an improved hook assembly.

Another object is to provide such a hook assembly which operates to preclude inadvertent discharge of a work load therefrom.

Another object is to provide such a hook assembly which is easily and conveniently operated under work conditions.

Another object is to provide such a hook assembly which is composed of components which operate cooperatively to prevent jamming even where some deformation occurs.

Another object is to provide such a hook assembly which automatically seals the throat of the hook when a work load is supported on the hook or the assembly otherwise subjected to tension.

Another object is to provide such a hook assembly which is extremely durable and operable to support work loads of great weight without structural failure.

Another object is to provide such a hook assembly which avoids the use of components such as springs, and the like which are highly susceptible to damage or breakage under work conditions.

Another object is to provide such a hook assembly which is adaptable for use in a wide variety of operative environments wherein it is necessary securely but releasibly to interconnect work pieces.

Further objects and advantages are to provide improved elements and arrangements thereof in an apparatus for the purposes described which is dependable, economical, durable and fully effective in accomplishing its intended purposes.

DESCRIPTION OF THE PREFERRED EMBODIMENT

Figure 1:
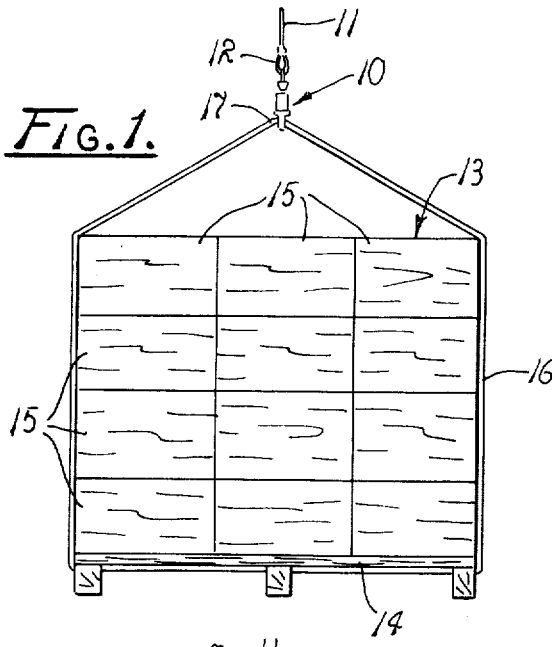
FIG. 1 is an elevation of the hook assembly of the present invention shown in a representative operative environment as in suspending a load on a cable.

Referring more particularly to the drawing, the hook assembly of the present invention is generally indicated by the numeral 10. The hook assembly is shown in FIG. 1 in a representative operative environment wherein a supporting line or cable 11, having a looped portion 12, is connected to the hook assembly as will hereinafter be described. A work load 13 is supported on the hook assembly. The work load is composed of a pallet 14 on which a plurality of containers 15 are stacked. A connecting line 16 is extended through the pallet and about the containers and connected at an upper end 17 to the hook assembly.

The hook assembly 10 has a housing or body 25 having a substantially cylindrical side wall 26. The side wall encloses an interior 27 and is concentric to a longitudinal axis indicated at 28 for purposes of illustrative convenience. The side wall has an end 29. A pair of opposed, aligned bores 30 are provided in the side wall defining a longitudinal axis 31 which is normal to and substantially coplanar with the longitudinal axis of the side wall, as can best be seen in FIG. 3.

The body 25 has an end wall 35 which is mounted on the end 29 of the side wall 26. The end wall has an interior surface 36 and is pierced by a central bore 37 which is coaxial with the longitudinal axis 28 of the side wall. A pair of diametrically opposed notches 38 of predetermined length are provided in the side wall in alignment along a plane substantially normal to a plane defined by the longitudinal axes 28 and 31. The notches define and thus are bounded by a first projection 39 of the side wall extending in a direction away from the end wall 35 on the left, as viewed in FIG. 3. The notches further define a second projection 40 of the side wall of predetermined greater length than the first projection extending substantially parallel to the first projection on the opposite side of and thus bounding the notches 38. The projections have a guide surface 41 extending about the notches and the remote ends of the projections to define an opening 42 for the body 25 remote from the end wall 35.

Figure 3:
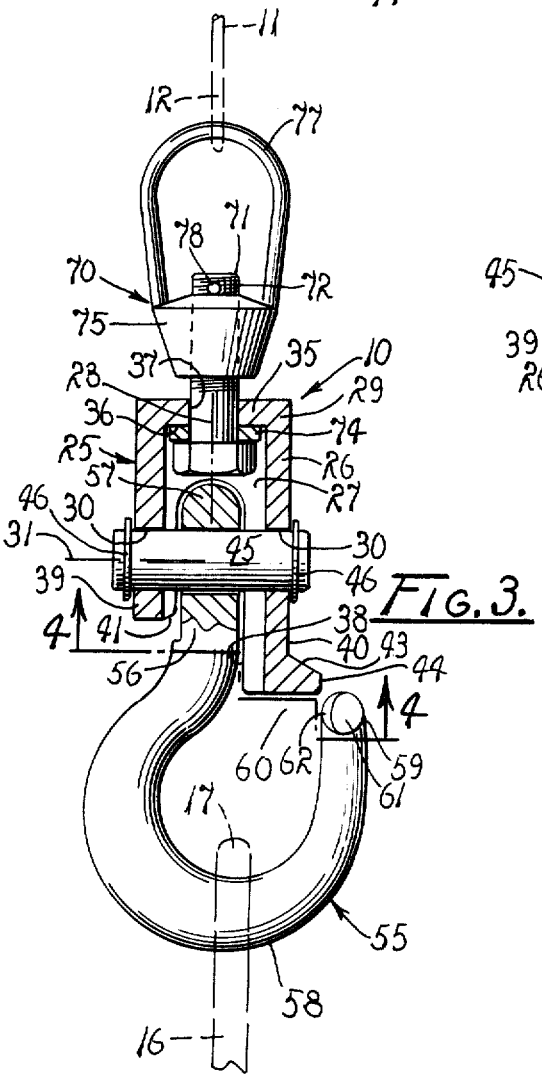
FIG. 3 is a partial longitudinal section taken on line 3—3 in FIG. 2.

The second projection 40 mounts an integral, radially extending flange 43 on the end thereof remote from the end wall 35 of the body 25. The flange has an arcuate, semi-circular guide surface 44 facing in a direction away from the first projection 39. A hardened steel pivot pin or shaft 45 is received in the pair of bores 30 and retained in position by a pair of snap rings 46 individually engaging the oppositely extending ends of the shaft externally of the body, as best shown in FIG. 3.

A forged steel hook 55 is mounted on the shaft 45. The hook has a shank portion 56 with an integral eye portion 57 at one end thereof through which the shaft 45 is extended to mount the hook for pivotal movement thereon. As best shown in FIG. 3, the eye portion is mounted on the shaft in substantially coplanar relation to a plane along which the notches 38 are aligned. The eye and shank portions of the hook are dimensioned for movement within the notches, as will hereinafter be described. The hook has a load-supporting or return bent portion 58 continuous with the shank portion and disposed along a plane substantially coplanar with the longitudinal axis 31 of the pair of bores 30 and substantially normal to the plane along which the notches are aligned.

The return bent portion 58 of the hook 55 extends to a position opposite the shank portion 56 to form an extremity 59. The extremity and the shank portion of the hook define a throat or entrance passage 60 for the hook. A guide 61 is mounted on the extremity 59 in substantially right-angular relation thereto and has an arcuate, semi-circular guide surface 62 disposed in juxtaposition to the guide surface 44 of the flange 43 when the hook is oriented, relative to the body 25, in the attitude shown in FIG. 3. For illustrative convenience, the attitude for hook shown in FIG. 3 and in full lines in FIG. 2 will be referred to as a "normal attitude 63" and the attitude shown in dashed lines in FIG. 2 will be referred to as a "release attitude 64".

An attaching assembly for the hook assembly 10 for the present invention is indicated at 70. The attaching assembly is composed of a bolt 71, preferably heat treated for strength, having an externally screw-threaded portion 72. The distal end of the screw-threaded portion of the bolt is pierced by a transverse bore 73. A hardened steel washer 74 is positioned on the bolt and the screw-threaded portion is inserted through the central bore 37 of the end wall 35, as shown in FIG. 3. An eye nut 75 is mounted on the screw-threaded portion of the bolt. The eye nut is composed of an internally screw-threaded nut portion 76 and an integral ring portion 77. The eye nut is mounted on the bolt by screw-threadably securing the nut portion on the screw-threaded portion of the bolt, as shown in FIG. 3. A lock pin 78 is extended through the transverse bore 73 to capture the nut portion on the bolt. Thus, the body 25 is mounted for rotational movement on the bolt 71 in coaxial relation to the longitudinal axis 28 of the side wall 26.

OPERATION

Figure 2:
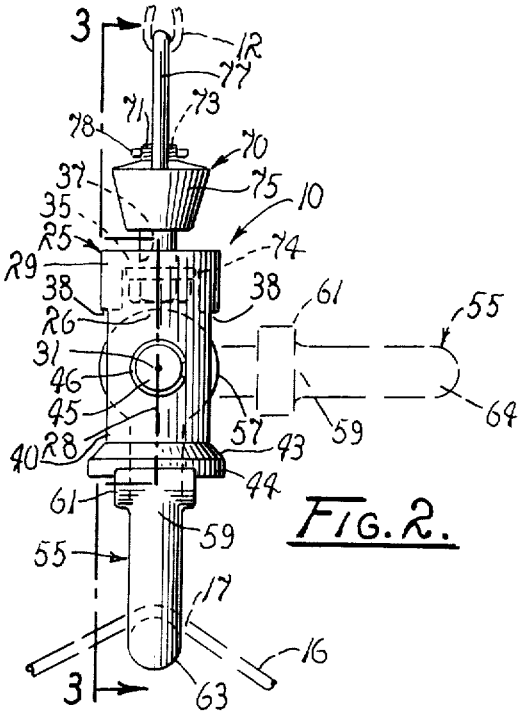
FIG. 2 is an end view of the hook assembly supported on a cable and showing the hook thereof in dashed lines in position for removal of a work load therefrom.

The operation of the described embodiment of the subject invention is believed to be clearly apparent and is briefly summarized at this point. In the representative operative environment shown in FIG. 1, the hook assembly 10 is mounted on the supporting line 11 by the formation of the loop portion 12 in the line extending through the ring portion 77 of the eye nut 75, as best shown in FIGS. 2 and 3. The line is secure in this looped configuration by any suitable means, not shown.

Figure 4:
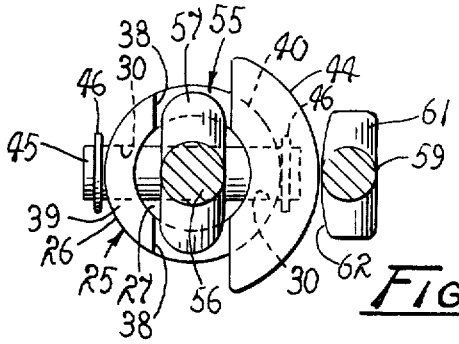
FIG. 4 is a transverse section taken from a position indicated by line 4—4 in FIG. 3.
Figure 5:
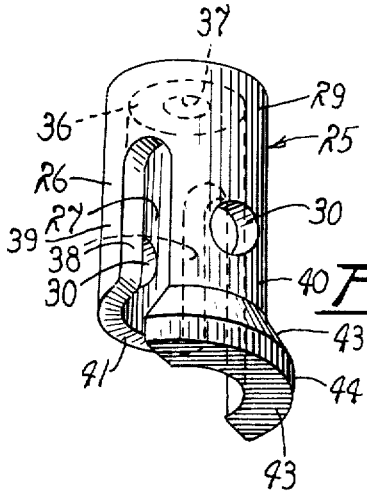
FIG. 5 is a perspective view of a body constituting a component of the hook assembly.

In order to attach a work load 13 to the hook assembly 10, the hook 55 is simply pivoted about the shaft 45 to the release attitude 64, shown in FIG. 2, approximately 90° from the normal position 63. The upper end 17 of the connecting line 16 is then simply extended through the entrance passage 60 of the hook and the hook released to pivot gravitationally to the normal attitude 63. As can perhaps best be visualized in FIG. 4, the juxtaposed guide surfaces 44 and 62 cooperate to insure that return of the hook to the normal attitude occurs smoothly without the possibility of the extremity 59 of the hook jamming against the body 25. If, because of inherent play in the hook assembly or because of deformation which has taken place in the components of the assembly as a result of strain occurring during use, the guide 61 and flange 43 come into contact during return of the hook to the normal attitude, the guide surfaces 44 and 62 respectively will engage to guide the hook to the normal attitude. Thus, at any time when the hook moves relative to the body, including when a heavy work load supported on the hook swings and transmits such movement to the hook, the guide surfaces prevent jamming which might otherwise cause the hook assembly to be rendered inoperable or discharge the work load from the hook.

Similarly, the guide surface 41, surrounding the notches 38 and opening 42 of the body 25, acts to prevent jamming of the shank portion and eye portion 56 and 57 respectively of the hook 55 during movement thereof. Any contact by the shank or eye portions of the hook with the body 25 is along the guide surface which automatically urges the shank and eye portions to the intended path of travel so as to preclude jamming.

As can best be seen in FIG. 3, the radially extending flange 43 and the guide 61 borne by the extremity 59 cooperate to obstruct the throat or entrance passage 60 of the hook 55 so as securely to retain the connecting line 16 in supported relation on the hook. As can best be visualized in FIG. 4, any swinging movement of the hook on the shaft 45 during use will not interfere with this safety feature of the hook assembly since the radially extending flange continues to obstruct the passage 60 during such a range of lateral movement. This safety feature is inherent in the structure of the assembly and operates automatically without the use of springs or other relatively temperamental and delicate structures employed in many prior art devices. Furthermore, pivotal movement of the return bent portion 58 of the hook is laterally of the plane defined thereby rather than in the plane of the return bent portion 58. Thus, there is no danger that the connecting line can slide off the hook through the passage 60 during uncontrolled swinging movement away from the passage as can occur in certain prior art devices.

The body 25 is mounted for rotational movement on the attaching assembly 70 about longitudinal axis 28 so as to allow positioning of the hook in the precise orientation desired for ease of attaching or removing a work load. When the connecting line 16 is to be removed from the hook 55, the tension on the supporting line 11 is simply relaxed and the hook manually pivoted on the shaft 45 to the release attitude 64 shown in dashed lines in FIG. 2 to permit removal of the connecting line.

It will thus be seen that the hook assembly of the present invention is easily operated under work conditions dependably to preclude the inadvertent discharge of work loads therefrom and which employs components of maximum durability which cooperate to prevent jamming even where some deformation of the components has occurred as the result of the abusive treatment normally associated with the use of hook assemblies.

Although the invention has been herein shown and described in what is conceived to be the most practical and preferred embodiment, it is recognized that departures may be made therefrom within the scope of the invention, which is not to be limited to the illustrative details disclosed.

Having described my invention, what I claim as new and desire to secure by Letters Patent is:

1. A hook assembly for dependably secure interconnection of a means of support and a work load, the assembly comprising a housing having a substantially cylindrical side wall with an integral end wall and an opposite open end; means extending through the end wall for mounting the housing on the means of support for rotation about an axis substantially coaxial with the cylindrical side wall; a hook having a load-supporting portion disposed in a reference plane and an integral eye portion defining a pivotal axis in said plane; a shaft mounted on the side wall extending through the eye portion of the hook and the housing in substantially right-angular relation to the axis of the mounting means to mount said load-supporting portion of the hook for pivotal movement on the shaft laterally from a normal position in which said plane of the load-supporting portion coincides with the axis of the mounting means; a radial flange borne by the housing having a semi-circular surface substantially concentric to the axis of the mounting means; and a guide mounted on the load-supporting portion of the hook substantially normal to the plane thereof and having a semi-circular surface juxtaposed the semi-circular surface of the flange when the hook is in the normal position to capture a work load supported on said load-supporting portion.

2. A hook assembly comprising:

A. a body having an end adapted for connection to a cable, an opposite end, an axis extended between said ends, a pair of aligned axially spaced bores disposed transversely of said axis and in intersecting relation thereto, a pair of spaced slots extended from said opposite end on opposite sides of said axis disposed in a plane coincident with said axis and normal to the aligned bores;

B. a shaft mounted in said bores;

C. a hook having an eye pivotally mounted on said shaft, a shank continuous with the eye moveable to and from the slots, a return bent portion continuous with the shank, and an end portion continuous with the return bent portion disposed in spaced relation to the shank and defining an entrance passage therebetween, said eye, shank, return bent portion and end portion being disposed in a plane substantially radial to the shaft and pivotal between a position aligned with said axis and opposite positions in the slots angularly displaced from the aligned position; and D. means integral with the body disposed in said entrance passage to block the same when the plane of the hook is substantially aligned with said axis and removed from the passage when the plane of the hook is angularly displaced having a semi-cylindrical convex surface disposed toward the end portion of the hook when the plane of the hook is aligned with the axis of the body, which surface is disposed substantially concentrically of said axis and is continuous with a semi-frusto-conical surface extended and constricted therefrom toward the end of the body adapted for connection to a cable.

3. A hook assembly comprising:

A. a body having an end adapted for connection to a cable, an opposite end, an axis extended between said ends, a pair of aligned axially spaced bores disposed transversely of said axis and in intersecting relation thereto, a pair of spaced slots extended from said opposite end on opposite sides of said axis disposed in a plane coincident with said axis and normal to the aligned bores;

B. a shaft mounted in said bores;

C. a hook having an eye pivotally mounted on said shaft, a shank continuous with the eye moveable to and from the slots, a return bent portion continuous with the shank, and an end portion continuous with the return bent portion disposed in spaced relation to the shank defining an entrance passage therebetween and having a substantially semi-circular convex surface disposed in a plane normal to said axis of the body, said eye, shank, return bent portion and end portion being disposed in a plane substantially radial to the shaft and pivotal between a position aligned with said axis and opposite positions in the slots angularly displaced from the aligned position; and D. a semi-circular guide integral with the body disposed in said entrance passage to block the same when the plane of the hook is substantially aligned with said pivotal axis and removed from the passage when the plane of the hook is angularly displaced, having a substantially semi-circular convex surface disposed in a plane normal to said axis and disposed toward the end portion of the hook when the plane of the hook is aligned with the axis of the body, in which said surface is continuous with a semi-frusto-conical surface on the body which is extended and constricted therefrom toward the end of the body adapted for connection to a cable.

* * * * *